US007448964B2

(12) United States Patent
Schweigert et al.

(10) Patent No.: US 7,448,964 B2
(45) Date of Patent: Nov. 11, 2008

(54) GOLF CLUB HEAD HAVING A CROWN WITH THIN REGIONS

(75) Inventors: Bradley D. Schweigert, Anthem, AZ (US); John C. Bliss, Glendale, AZ (US)

(73) Assignee: Karsten Manufacturing Corporation, Phoenix, AZ (US)

( * ) Notice: Subject to any disclaimer, the term of this patent is extended or adjusted under 35 U.S.C. 154(b) by 129 days.

(21) Appl. No.: 11/516,373

(22) Filed: Sep. 6, 2006

(65) Prior Publication Data

US 2007/0155539 A1 Jul. 5, 2007

Related U.S. Application Data

(60) Provisional application No. 60/719,085, filed on Sep. 20, 2005.

(51) Int. Cl.
*A63B 53/04* (2006.01)

(52) U.S. Cl. ..... 473/345; 473/346; 473/349

(58) Field of Classification Search ..... 473/324–350
See application file for complete search history.

(56) References Cited

U.S. PATENT DOCUMENTS 838,284 A * 12/1906 Thompson ..... 473/329
4,139,196 A * 2/1979 Riley ..... 473/242
4,214,754 A 7/1980 Zebelean
4,930,781 A * 6/1990 Allen ..... 473/346
5,004,241 A * 4/1991 Antonious ..... 473/327
5,067,715 A 11/1991 Schmidt et al.
5,346,217 A * 9/1994 Tsuchiya et al. ..... 473/345
5,346,218 A * 9/1994 Wyte ..... 473/346
5,419,559 A * 5/1995 Melanson et al. ..... 473/346
5,497,993 A * 3/1996 Shan ..... 473/329
5,533,728 A * 7/1996 Pehoski et al. ..... 473/252
5,624,331 A * 4/1997 Lo et al. ..... 473/345
5,700,208 A * 12/1997 Nelms ..... 473/324
5,772,529 A * 6/1998 Ruth, Jr. ..... 473/327
5,921,872 A * 7/1999 Kobayashi ..... 473/345
5,954,596 A 9/1999 Noble et al.
6,027,416 A 2/2000 Schmidt et al.
6,776,723 B2 8/2004 Bliss
6,776,725 B1 * 8/2004 Miura et al. ..... 473/327
6,783,465 B2 * 8/2004 Matsunaga ..... 473/329
7,008,332 B2 * 3/2006 Liou ..... 473/345
7,108,614 B2 * 9/2006 Lo ..... 473/345
7,250,007 B2 * 7/2007 Lu ..... 473/329
7,258,624 B2 * 8/2007 Kobayashi ..... 473/324
D553,206 S * 10/2007 Morales et al. ..... D21/733

(Continued)

*Primary Examiner*—Sebastiano Passaniti
(74) *Attorney, Agent, or Firm*—Darrell F. Marquette; John D. Titus

(57) ABSTRACT

A golf club head includes a hollow body having a front wall, a crown and a sole. The crown has a thickness dimension measured between its inner and outer surfaces. An outer edge of the crown extends in a generally arcuate path between heel and toe ends of the hollow body. A plurality of thin regions in the crown is arranged in a matrix pattern. The plurality of thin regions includes a first row of thin regions disposed adjacent the outer edge of the crown and a second row of thin regions disposed inwardly of the first row of thin regions. The crown thickness dimension in the plurality of thin regions is reduced when compared with the crown thickness dimension in other regions of the crown.

27 Claims, 2 Drawing Sheets

U.S. PATENT DOCUMENTS

| | | | | |
|---|---|---|---|---|
| 7,281,992 | B2 * | 10/2007 | Tseng | 473/345 |
| D557,362 | S * | 12/2007 | Serrano et al. | D21/752 |
| 2004/0192468 | A1 * | 9/2004 | Onoda et al. | 473/345 |
| 2005/0143189 | A1 * | 6/2005 | Lai et al. | 473/335 |
| 2005/0261082 | A1 * | 11/2005 | Yamamoto | 473/345 |
| 2006/0052181 | A1 * | 3/2006 | Serrano et al. | 473/345 |
| 2006/0293118 | A1 * | 12/2006 | Meyer et al. | 473/329 |
| 2007/0032313 | A1 * | 2/2007 | Serrano et al. | 473/349 |
| 2007/0155533 | A1 * | 7/2007 | Solheim et al. | 473/334 |
| 2008/0045356 | A1 * | 2/2008 | Lin et al. | 473/346 |

* cited by examiner 12
10
14
16
17
20
22
28
30
34
35
38
40
42
24
26
32

GOLF CLUB HEAD HAVING A CROWN WITH THIN REGIONS

This is a nonprovisional application claiming the benefit of provisional application No. 60/719,085 filed Sep. 20, 2005.

BACKGROUND OF THE INVENTION

The present invention relates generally to golf equipment and, in particular, to a golf club head having a crown with thin regions.

U.S. Pat. No. 5,954,596 to Noble et al discloses a golf club head including a hollow body with a front wall, a top wall or crown, a bottom wall or sole, and a side wall or skirt. The front wall varies in thickness while the top, bottom and side walls are substantially uniform in thickness.

U.S. Pat. No. 6,776,723 to Bliss et al discloses a golf club head including a hollow body with a front wall, a top wall, a bottom wall and a side wall as disclosed in the Noble et al patent. The front wall varies in thickness, and a weight member located on the sole lowers the center of gravity of the club head.

SUMMARY OF THE INVENTION

The present invention provides a golf club head including a hollow body having a heel end, a toe end, a front wall, a crown and a sole. The crown extends rearwardly from an upper portion of the front wall, and the sole extends rearwardly from a lower portion of the front wall. The crown has inner surface, an outer surface, a thickness dimension measured between the inner and outer surfaces, and an outer edge extending in a generally arcuate path between the heel and toe ends of the hollow body. A plurality of thin regions in the crown is arranged in a web-shaped pattern. The plurality of thin regions includes a first row of thin regions disposed adjacent the outer edge of the crown and a second row of thin regions disposed inwardly of the first row of thin regions. The crown thickness dimension in the plurality of thin regions is reduced when compared with the crown thickness dimension in other regions of said crown.

DESCRIPTION OF THE INVENTION

Figures 1, 2, 3:
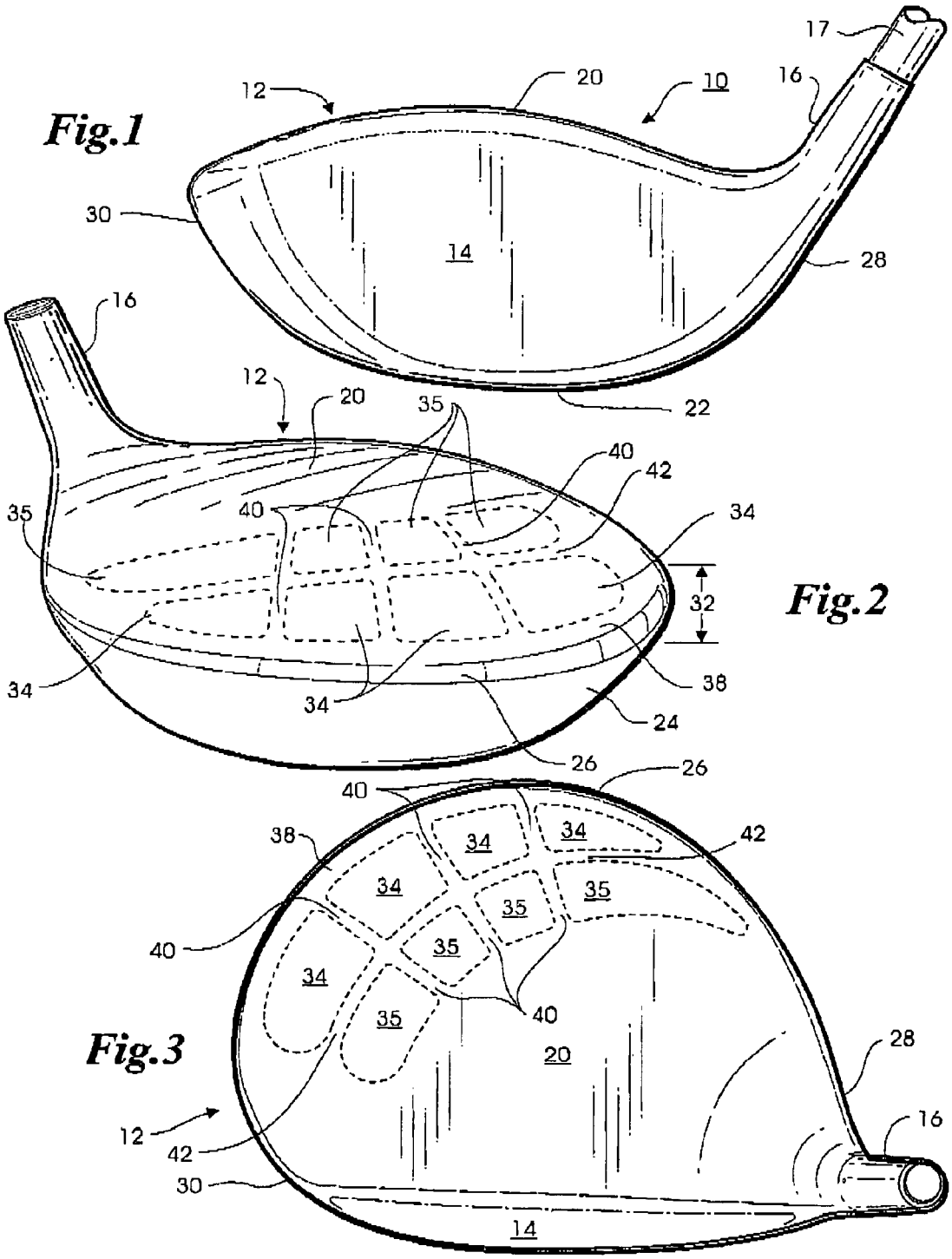
FIG. 1 is a front elevation view of a golf club head according to one embodiment of the present invention.
FIG. 2 is a rear perspective view of the golf club head of FIG. 1.
FIG. 3 is a top view of the golf club head of FIG. 1.

With reference to FIGS. 1-3, a golf club head 10 comprises a hollow body 12 preferably formed of titanium having a front wall 14 for impacting a golf ball, and a hosel 16 adapted to receive a golf club shaft 17. Hollow body 12 further includes a crown 20, a sole 22 and a skirt 24. The crown 20 extends rearwardly from an upper portion of the front wall 14, and the sole 22 extends rearwardly from a lower portion of the front wall 14. Crown 20 and skirt 24 meet along an outer edge 26 of the crown 20 which, preferably, extends in an arcuate path between a heel end 28 of hollow body 12 and a toe end 30 of hollow body 12. The skirt 24 extends from the crown outer edge 26 toward the sole 22. The crown 20 has a thickness dimension measured between its inner and outer surfaces.

The region surrounding crown outer edge 26 preferably forms an outer perimeter region 32 that smoothly blends crown 20 and skirt 24 together. Outer perimeter region 32 preferably ranges from about 0.700 inch above and about 0.700 inch below the crown outer edge 26, more preferably about 0.350 inch above and about 0.350 inch below the crown outer edge 26, and most preferably about 0.250 inch above and about 0.250 inch below the crown outer edge 26.

Hollow body 12 may be formed by investment casting or it may be assembled from a series of forged pieces that are welded or brazed together. Crown 20 is formed with a plurality of thin regions 34, 35 arranged in a matrix pattern, preferably an arcuate matrix or web-shaped pattern of at least two rows of thinned sections. The plurality of thin regions 34, 35 includes a first row of thin regions 34 disposed adjacent the crown outer edge 26, and a second row of thin regions 35 disposed inwardly of the first row of thin regions 34.

The first row of thin regions 34 is spaced from the crown outer edge 26 to form a substantially arcuate rib 38 that extends along the outer perimeter region 32. In addition, the thin regions 34 and 35 are spaced apart to form substantially linear ribs 40 that are connected to the arcuate rib 38. The first and second rows of thin regions 34,35 are spaced apart to form a substantially arcuate rib 42 disposed radially inward from arcuate rib 38. The arcuate ribs 38, 42 and the linear ribs 40 define the web-shaped pattern in which the thin regions 34, 35 are arranged while maintaining the strength of the crown 20.

The thin regions 34, 35 are formed such that the thickness dimension of the crown 20 in the thin regions 34, 35 is reduced when compared with the thickness dimension of the crown 20 in other regions of the crown 20. The approximate thickness dimension of the thin regions 34, 35 may range from 0.016 to 0.030 inch, or more preferably from 0.018 to 0.028 inch, and most preferably from 0.020 to 0.026 inch. Other regions of the crown 20 have a thickness dimension greater than 0.030 inch.

The web-shaped pattern in which the thin regions 34, 35 are arranged removes approximately 3 grams of unneeded material in the crown 20. The material removed from the crown 20 is preferably redistributed to the sole 22 thereby lowering the center of gravity of the club head 10 approximately 0.020 inch toward the sole 22.

Figure 4:
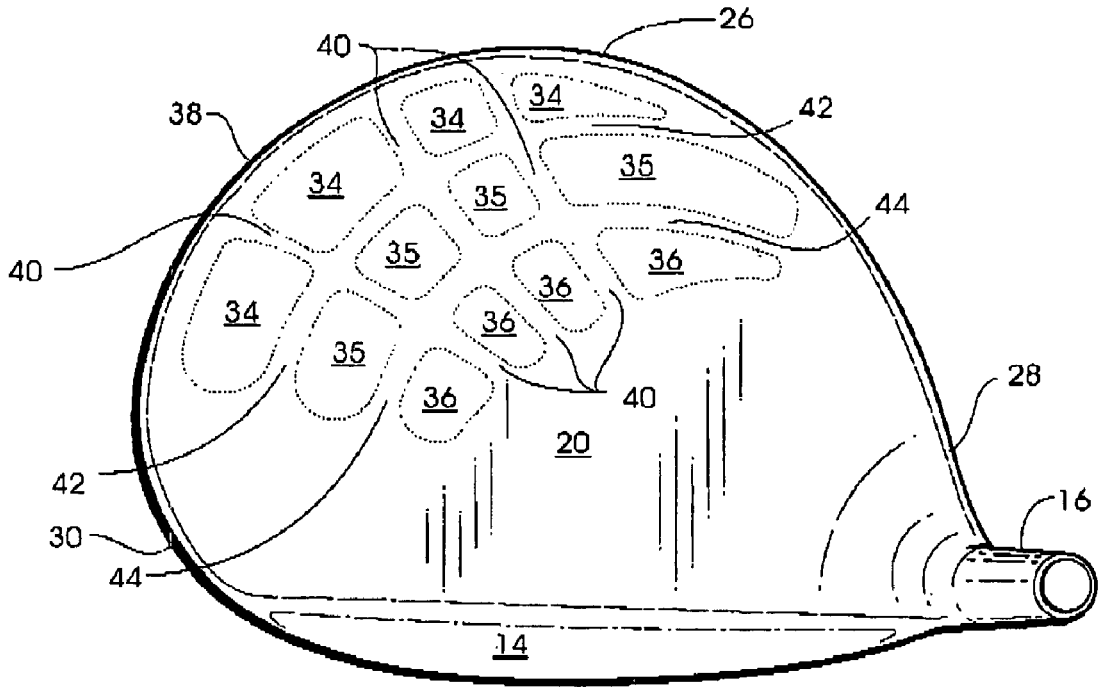
FIG. 4 is a top view of a golf club head according to another embodiment of the present invention.

In the embodiment of the golf club head 10 shown in FIG. 4, a third row of thin regions 36 is disposed inwardly of the second row of thin regions 35. A further substantially arcuate rib 44 is disposed radially inward from the arcuate rib 42 between the second and third rows of thin regions 35, 36.

What is claimed is:

1. A golf club head comprising:

a hollow body having a heel end, a toe end, a front wall, a crown extending rearwardly from an upper portion of said front wall, and a sole extending rearwardly from a lower portion of said front wall;

said crown having an inner surface, an outer surface and a thickness dimension measured between said inner and outer surfaces;

a plurality of thin regions in said crown, each of said plurality of thin regions arranged to form a plurality of rows of thin regions, each row of said plurality of rows being separated from an adjacent row by an arcuate rib having a thickness greater than the thickness of said plurality of thin regions, each of said plurality of thin regions in a row further being separated from an adjacent thin region by a substantially linear rib having a thickness greater than the thickness of said plurality of thin regions; and said thickness dimension in said plurality of thin regions being reduced when compared with said thickness dimension in other regions of said crown.

2. The golf club head of claim 1, wherein:

said thickness dimension in said plurality of thin regions is between 0.016 and 0.030 inch; and said thickness dimension of said ribs and in said other regions of said crown is greater than 0.030 inch.

3. The golf club head of claim 2, wherein said thickness dimension in said plurality of thin regions is between 0.018 and 0.028 inch.

4. The golf club head of claim 3, wherein said thickness dimension in said plurality of thin regions is between 0.020 and 0.026 inch.

5. The golf club head of claim 1, further comprising:

said crown also having an outer edge extending in a generally arcuate path between the heel and toe ends of said hollow body; and a skirt extending from the outer edge of said crown toward said sole.

6. The golf club head of claim 1, further comprising a hosel on said hollow body for receiving a golf club shaft.

7. The golf club head of claim 1, wherein:

said plurality of thin regions is arranged in the form of a matrix of thin regions.

8. The golf club head of claim 1, wherein:

said crown is formed of a unitary metallic material.

9. The golf club head of claim 1, wherein:

said plurality of thin regions comprise depressions formed in a inner surface of said crown.

10. The golf club head of claim 1, wherein:

said plurality of rows comprises a first row and a second row, said second row being disposed inward of said first row.

11. The golf club head of claim 10, wherein, said second row has at least two thin regions.

12. The golf club head of claim 10, wherein said second row has four thin regions.

13. The golf club head of claim 10, wherein said first row has at least two thin regions.

14. The golf club head of claim 10, wherein said first row has four thin regions.

15. The golf club head of claim 10, wherein, further comprising:

a middle row disposed between said first row and said second row.

16. The golf club head of claim 15, wherein:

said middle row has at least two thin regions.

17. A golf club comprising:

a golf club head, said golf club head comprising a hollow body having a heel end, a toe end, a front wall, a crown extending rearwardly from an upper portion of said first wall, and a sole extending rearwardly from a lower portion of said front wall;

said crown having an inner surface, an outer surface and a thickness dimension measured between said inner and outer surfaces;

a plurality of thin regions on said crown, each of said plurality of thin regions arranged to form a plurality of rows of thin regions, each row of said plurality of rows being separated from an adjacent row by arcuate rib having a thickness greater than the thickness of said plurality of thin regions, each of said plurality of thin regions in a row further being separated from an adjacent thin region by a substantially linear rib having a thickness greater than the thickness of said plurality of thin regions; and a golf club shaft attached to said golf club head.

18. The golf club of claim 17, wherein, said pluality of rows comprises a first row and a second row, said second row being disposed inward of said first row.

19. The golf club of claim 18, wherein, said second row has at least two thin regions.

20. The golf club of claim 18, wherein said second row has four thin regions.

21. The golf club of claim 18, wherein said first row has at least two thin regions.

22. The golf club of claim 18, wherein said first row has four thin regions.

23. The golf club of claim 18, further comprising:

a middle row disposed between said first row and said second row.

24. The golf club of claim 23, wherein:

said middle row has at least two thin regions.

25. The golf club of claim 17, wherein:

said crown is formed of unitary metallic metal.

26. The golf club of claim 17, wherein:

said plurality of thin regions comprise depressions formed in said inner surface of said crown.

27. A golf club head comprising:

a hollow body having a heel end, a toe end, a front wall, a crown extending rearwardly from an upper portion of said wall, and a sole extending rearwardly from a lower portion of said front wall;

said crown being formed of a unitary metallic material having an inner surface, an outer surface and a thickness dimension measured between said inner and outer surfaces;

a plurality of thin regions in said crown, each of said plurality of thin regions arranged to form a plurality of rows of thin regions, each row of said plurality of rows being separated from an adjacent row by arcuate rib having a thickness greater than the thickness of said plurality of thin regions, each of said plurality of thin regions in a row further being separated from an adjacent thin region by a substantially linear rib having a thickness greater than the thickness of said plurality of thin regions; and said thickness dimension in said plurality of thin regions being reduced when compared with said thickness dimension in other regions of said crown.

* * * * *

UNITED STATES PATENT AND TRADEMARK OFFICE

CERTIFICATE OF CORRECTION

PATENT NO. : 7,448,964 B2
APPLICATION NO. : 11/516373
DATED : November 11, 2008
INVENTOR(S) : Schweigert et al.

It is certified that error appears in the above-identified patent and that said Letters Patent is hereby corrected as shown below:

Column 3, line 30 (Claim 9), delete “a” and insert --said-- before the text reading “inner surface of said crown.”

Column 3, line 43 (Claim 15), delete “wherein,” after the text reading “15. The golf club head of claim 10,”

Column 3, line 52 (Claim 17), delete “first” and insert --front-- after the text reading “extending rearwardly from an upper portion of said”

Column 4, line 1 (Claim 17), delete “in” and insert --on-- after the text reading “a plurality of thin regions”

Column 4, line 4 (Claim 17), insert --an-- after the text reading “being separated from an adjacent row by”

Column 4, line 13 (Claim 18), delete “pluality” and insert --plurality-- after the text reading “said”

Column 4, line 30 (Claim 25), insert --a-- after the text reading “said crown is formed of”; and delete “metal” and insert --material-- after the text reading “unitary metallic”

Column 4, line 37 (Claim 27), insert --front-- after the text reading “said” and before the text reading “wall”

Column 4, line 46 (Claim 27), insert --an-- before the text reading “arcuate rib”

Signed and Sealed this

Twenty-fourth Day of March, 2009

JOHN DOLL
*Acting Director of the United States Patent and Trademark Office*